United States Patent [19]

Saito et al.

[11] Patent Number: 4,702,586

[45] Date of Patent: Oct. 27, 1987

[54] COPY BOARD APPARATUS

[75] Inventors: Takashi Saito, Ichikawa; Hiroshi Nitanda, Tokyo; Tsuneki Inuzuka, Yokohama; Mitsuhiro Tokuhara, Chigasaki; Haruhisa Honda, Yokohama, all of Japan

[73] Assignee: Canon Kabushiki Kaisha, Tokyo, Japan

[21] Appl. No.: 883,653

[22] Filed: Jul. 9, 1986

[30] Foreign Application Priority Data

Jul. 11, 1985 [JP] Japan ..... 60-153018

[51] Int. Cl.[4] ..... G03G 15/00

[52] U.S. Cl. ..... 355/3 R; 355/11; 355/66

[58] Field of Search ..... 355/3 R, 5, 11, 77, 355/44, 45, 66, 112

[56] References Cited

U.S. PATENT DOCUMENTS 3,874,789 4/1975 Weber ..... 355/5

4,367,033 1/1983 Watanabe ..... 355/5

*Primary Examiner*—R. L. Moses

*Attorney, Agent, or Firm*—Fitzpatrick, Cella, Harper & Scinto

[57] ABSTRACT

A copy board apparatus for copying information on a web-like writing board supported by rollers with an electrophotographic copier disposed adjacent one longitudinal end of the writing board. The apparatus has a first optical system for optically connecting the writing board and a photosensitive member of the copier, a second optical system for optically connecting an original on the copier and the photosensitive member, and change-over circuitry which permits switching between the two optical systems.

8 Claims, 11 Drawing Figures

112
111
113
NO3
COM3
NC3
NO2
COM2
NC2
NO1
COM1
NC1
+24V
127
133
135
137
139
129
131
BOARD ILLUMINATION LAMP LIGHTING INSTRUCTION
BOARD MEMBER REFERENCE POSITION DETECTION SIGNAL
REGISTER TIMING SIGNAL
EXPOSURE LAMP LIGHTING INSTRUCTION SIGNAL
ORIGINAL SHEET POSITION DETECTION SIGNAL
ORIGINAL SHEET ILLUMINATION LAMP LIGHTING INSTRUCTION

COPY BOARD APPARATUS

BACKGROUND OF THE INVENTION

1. Field of the Invention

The present invention relates to a copy board apparatus having a board for writing information such as letters and figures thereon and a copier capable of copying the information written on the board.

2. Description of the Related Art

Known copy board apparatus can be broadly classified into two types: namely, a first type in which the information written on the board is projected onto an image sensor such as a CCD so as to be digitized and then output by a printer such as a thermal printer, and a second type in which the information written on the board is copied by an electrophotographic copying machine, as is the case of the copy board apparatus to which the present invention pertains.

The copy board apparatus of the first type mentioned above is advantageous in that, since the information written on the board is digitized, it can be processed and edited in various ways and, if necessary, transmitted to a distal station through suitable telecommunication means. Although various output methods are usable in combination with this type of apparatus, a thermal printer is used most commonly as the output means because of its moderate cost. The thermal printer, however, requires use of so-called heat-sensitive paper which has undergone special treatment so as to generate color in response to heat. The heat-sensitive paper, however, is expensive as compared with ordinary paper and is not suitable for writing on with a pencil or similar writing instrument. In addition, heat-sensitive paper is rather difficult to handle because of lack of stiffness.

On the other hand, the copy board apparatus of the second type is basically constituted, as shown in FIG. 1, by a board section a, an electrophotographic copier section b and a base c for the copier. In operation, a sheet material is scrolled so as to move along the board surface and the information written on the sheet is illuminated and an image of the information is projected on the copier b under the board so that it is copied by the copier. The copy board apparatus of this type is advantageous in that it permits the information on the copy board to be copied on ordinary paper sheets. In addition, the copier section can be used as a copier, independently of the board section a.

In order that the advantages of this type of copy board apparatus be fully enjoyed, it is essential that the copier is placed under the board. This arrangement, however, is inconvenient when the copier section is used independently as a copier, because there is no clearance between the copier section and the board section which would enable the cover on the original sheet carrier of the copier to be fully opened. When the copier section is used as a copier, therefore, it is necessary to move the copier section to a suitable place where the cover of the original sheet carrier of the copier can be fully opened. It is quite troublesome to move the copier section away from the board section each time a copying operation takes place, considering that the copying of documents and distribution of the same are frequently required during meetings or conferences.

SUMMARY OF THE INVENTION

Accordingly, an object of the invention is to provide a copy board apparatus which is easy to handle and which is free from the problems of the prior art described hereinbefore.

Another object of the invention is to provide a copy board apparatus which is improved in such a manner as to enable the copier section to copy both the information written on the board and another document set on the copier section, without requiring the copier section to be moved from a predetermined position where it is optically coupled to the board section.

Still another object of the invention is to provide a combination of an electronic circuit and an optical system which enables the construction of the copy board apparatus of the kind described.

To these ends, according to the invention, there is provided a copy board apparatus for copying information recorded on a writing board, the apparatus comprising: a board section including a web forming the writing board, rollers for supporting the web such that the web extends in a plane, and driving means for driving at least one of the rollers thereby to move the web; a copier section including an electrophotographic copier having an original carrier and a photosensitive member, the copier being disposed adjacent one longitudinal end of the writing board; a first optical system for forming, on the photosensitive member, an image of the information recorded on the web; a second optical system for forming, on the photosensitive member, an image of an original on the original carrier; and changeover means for effecting switching between the first and second optical systems.

The above and other objects, features and advantages of the invention will become clear from the following description of the preferred embodiments taken in conjunction with the accompanying drawings.

DESCRIPTION OF THE PREFERRED EMBODIMENTS

Figure 2A:
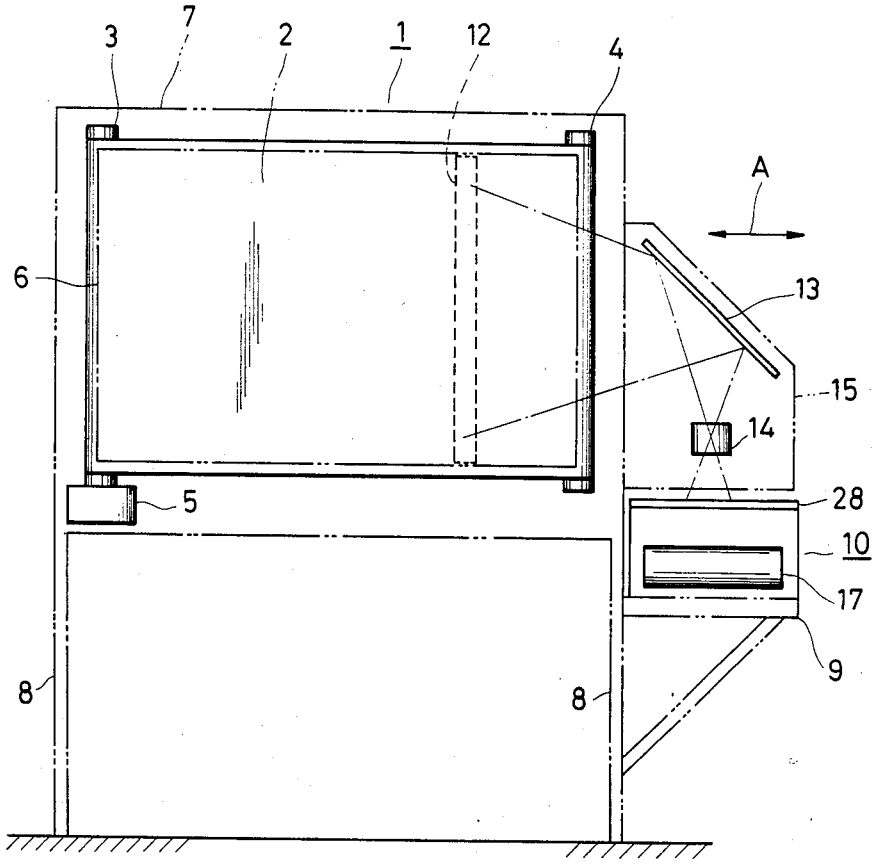
FIGS. 2A and 2B are schematic front elevational views of a first embodiment of the present invention, showing the different portions of an associated optical system.
Figure 2B:
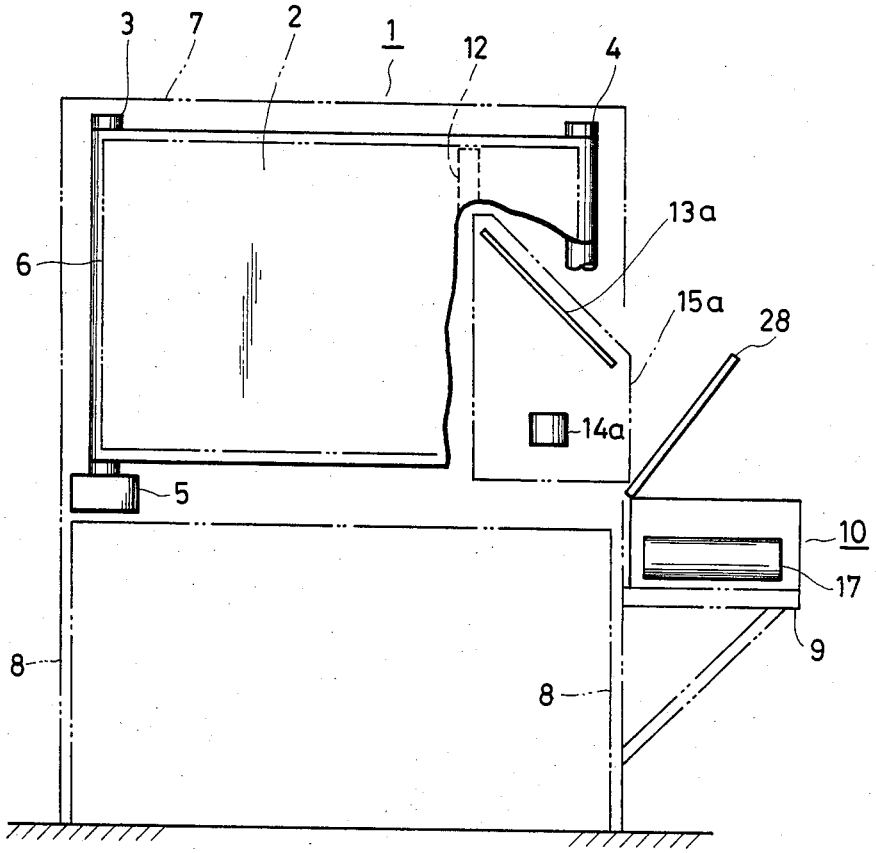
Figure 3:
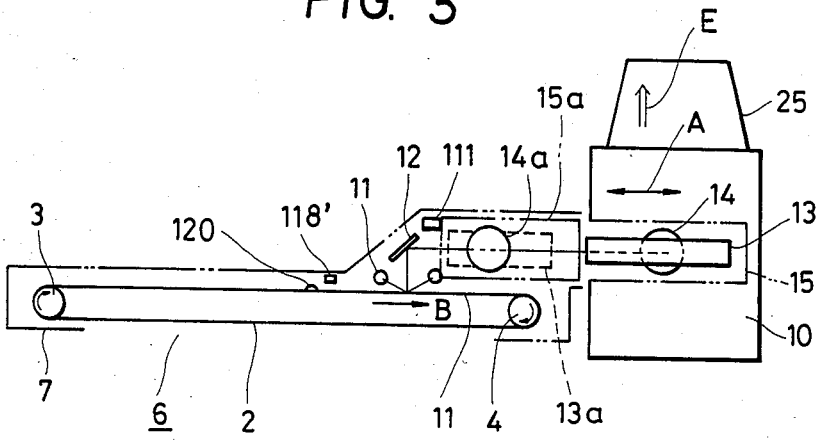
FIG. 3 is a plan view of the first embodiment shown in FIGS. 2A and 2B.

FIGS. 2A and 2B are front elevational views and FIG. 3 is a plan view of a first embodiment of the copy board apparatus in accordance with the present invention. The copy board apparatus has a board section 1 provided with a flexible white sheet or a web 2 stretched between rollers 3 and 4 such that its surface is disposed in a substantially vertical plane. At least one of the rollers 3 and 4 is adapted to be driven in the arrow direction (see FIG. 3) by a motor 5, whereby the sheet is moved in the direction of the arrow B past an optical system which will be explained later.

The sheet is placed in a frame 7 which is provided with a window 6 through which it is exposed. The frame 7 is supported on the floor through legs 8. A support 9 for supporting an electrophotographic copier 10 is provided on the frame 7 and the legs 8. The copier 10 may either be placed on base 9 or may be fixed thereto as by means of small screws. The copier 10 is disposed on one longitudinal end of the board section 1. In the illustrated embodiment, the copier 10 is placed on the right-hand side of the board section 1 as viewed in FIGS. 2A and 2B, although it may be placed on the left-hand side of the board section 1.

An optical system for projecting an image of the information written on the board onto the copier 10 includes lamps 11 for illuminating the sheet 2 in the board copying mode, a mirror 12 fixed to the frame 6 and adapted to laterally reflect the light from sheet 2, a mirror 13 for downwardly reflecting the light from the mirror 13, and an image forming lens 14 which is adapted to focus the light from the mirror 13 so as to form an image on an electrophotographic photosensitive member 17 in the copier 10. These mirrors and lens are fixed to a movable frame or hood 15. When the copy board apparatus is used in a board copying mode, the hood 15 is stationarily held at an operating position illustrated in FIG. 2A, so as to introduce light from the white sheet 2 to the copier 10, whereas, in the document copying mode for copying a document carried by an original sheet carrier on the copier 10, the hood 15 is stored in the frame 7 so as not to hinder the opening of an original cover which presses the original document onto the original sheet carrier surface. This storage is carried out by translationally moving the hood 15 into a housing portion of the frame 7. The hood received in the housing portion in the frame 7 is designated by a numeral 15*a*, while numerals 13 and 14*a* designate the mirror and image forming lens in the hood 15. As will be seen from FIG. 2B, when the hood 15 is received in the housing portion of the frame 7, the original cover 28 of the copier 10 can be operated freely without being interfered with by the hood 15, even though the copier is kept stationary.

Thus, in the document copying mode, the hood 15 is held at a retracted position which is deviated from a position right above the copier 10. The movement of the hood 15 to and from the retracted position may be effected by manual force or, alternatively, by the power from an electric motor.

The electrophotographic copier in the copy board apparatus of the invention will be explained hereinunder.

Figure 4:
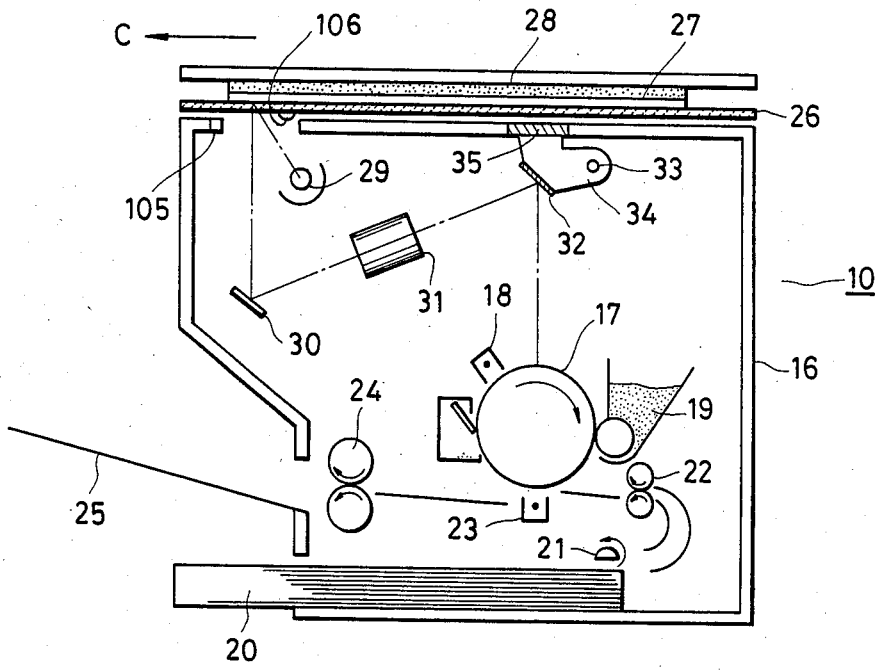
FIG. 4 is a schematic illustration of the essential portions of the copier section.

Referring to FIG. 4, the copier 10 has a frame 16 which accommodates electrophotographic processing devices which are known per se. More specifically, the electrophotographic copier 10 accommodates a charger 18 which is adapted to uniformly charge a photosensitive member 17 to which the image of the information written on the board or the image of the document on the original document carrier is projected depending on whether the apparatus operates in the board copying mode or the document copying mode, thereby forming an electrostatic latent image which is then developed into a toner image.

On the other hand, transfer sheets are housed in a transfer sheet housing section 20 and are fed one-by-one by a feed roller 21. Each transfer sheet is conveyed into the transfer section in synchronism with the toner image, whereby the toner image is transferred to a predetermined portion of the transfer member. This transfer is effected by a transfer charger 23. After transfer, the transfer sheet is passed through a fixing device 24 where the transferred image is fixed and then ejected to an ejection tray 25.

The original document 27 is placed on the original sheet carrier 26, and is pressed by the original cover 28 onto the original sheet carrier 26. As is well known, the original cover 28 is hinged to the sheet carrier 26 so as to swing into and out of contact with the sheet carrier 26. Thus, the insertion and withdrawal of an original document is conducted while the original cover is swung away from the original sheet carrier 26, and is pressed by original cover 28 onto the original sheet carrier 26 when the original cover is swung into contact with the original sheet. The original sheet carrier is adapted to be moved in the direction of arrow C when the copier section is used in the document copying mode, to effect scanning of the original. During this operation, the original is illuminated by a lamp 29 and the light reflected from the original is projected onto the photosensitive member 17 through a second optical system which includes a mirror 30, lens 31 and a mirror 32.

During the copying of the original carried by the original sheet carrier 26, the mirror 32 is placed at the position shown in FIG. 4. The mirror 32 is secured to a support member 34 which is pivotally carried by a shaft 33. A cover 35 for closing an opening formed in the frame 16 is secured to the supporting member 34. This supporting member 34 is adapted to be actuated by, for example, a solenoid.

Figure 5:
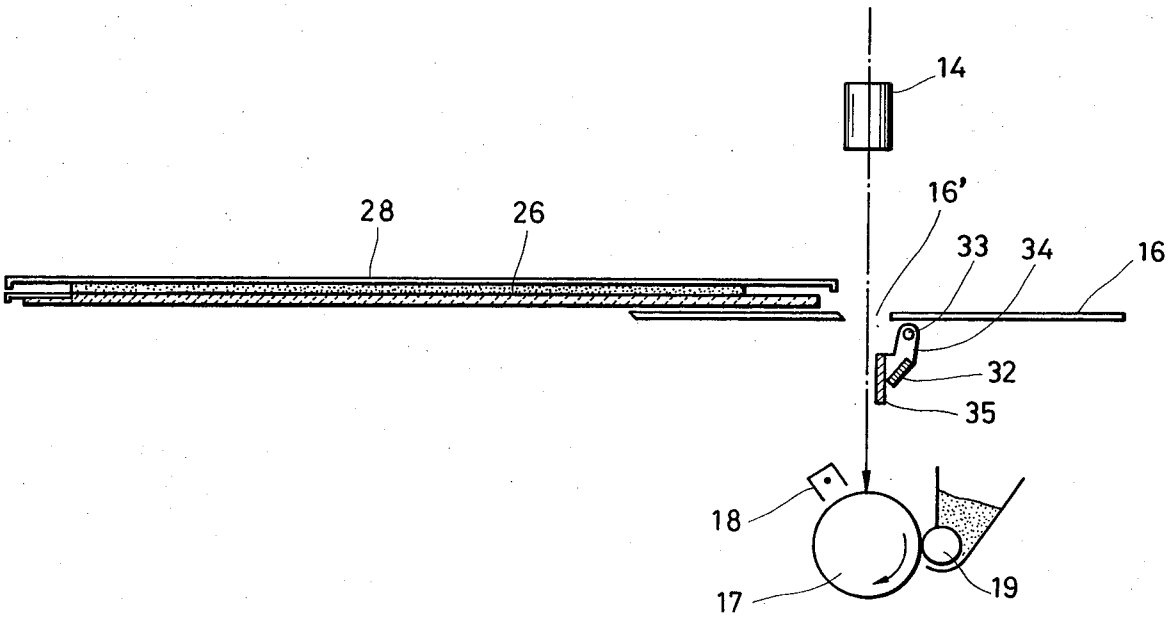
FIG. 5 is a schematic illustration of a portion of the copier.

FIG. 5 illustrates the arrangement of elements for copying in the board copying mode. The original sheet carrier 26 and the cover 28 are held at the retracted position shown in FIG. 5. At the same time, the supporting member 34 is moved to the illustrated position, to provide an opening 16' in the frame 16. Meanwhile, the mirror 32 and the cover 35 are retracted to positions where they do not impede passage of a beam of light from the board along a first optical path to the photosensitive member. As a result, the photosensitive member 17 is exposed to an image of the information on the board which is illuminated by the lamps 11.

Figure 6:
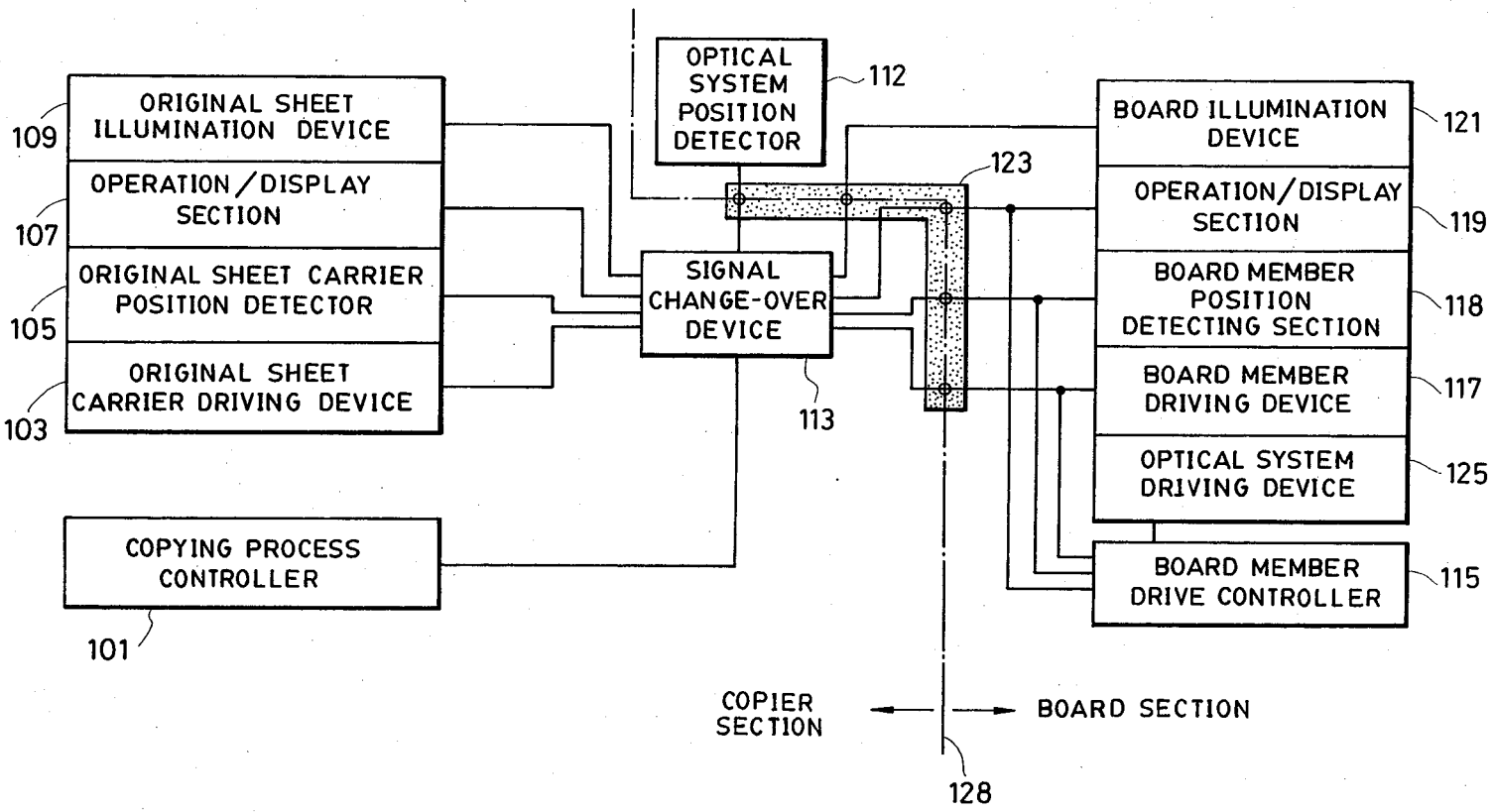
FIGS. 6 and 7 are a block diagram and a schematic illustration of a controller for the present invention.

A description will now be made as to the electric circuit for the apparatus of the invention with specific reference to FIG. 6. In this Figure, a dot-and-dash line 128 represents the boundary or interface between the copier section 10 and the board section 1, both sections being connected to each other through a connection device 123.

The copier section of the electric circuit is substantially the same as that of conventional copiers except that a later-mentioned signal change-over device is provided. Briefly, the copier section of the electric circuit includes an original illumination device 109 which includes a halogen lamp or a similar lighting device, and is adapted to illuminate the original on the original sheet carrier 26 in accordance with the lighting instructions from a copying process controller 101. An operation/display section 107 is a device which has keys such as a copy key, a copy number setting key and other necessary keys, as well as a display function such as the display of the number of completed copies, a jamming indicator and so forth.

An original sheet carrier position detector 105 is a detector adapted to detect the arrival of the original sheet carrier 26 at a predetermined position during its movement in the direction of the arrow C in FIG. 4. For instance, the original sheet carrier position detector 105 may be a microswitch 10*b* adapted to be operated by a cam provided on the sheet carrier 26. The driving of a register roller 22 is started in response to the generation of the signal from the detector 105. The driving of the register roller 22 may be done simultaneously with the generation of the signal from the detector 105 or after a lapse of a predetermined time through a delay circuit (not shown).

The original sheet carrier driving device 103 is a device which controls the forward and backward movement of the original sheet carrier 26, as well as the stopping of the same. The described embodiment makes use of a pair of clutches.

The copying process controller 101 generally includes all the control functions necessary for ordinary copiers, except for the devices 103, 105, 107 and 109 mentioned above, and is capable of controlling the copying process which includes charging, development, transfer, transportation of the transfer member, and fixing.

The board section of the electric circuit includes an illumination device 121 which is adapted to control the state of lighting and the light quantity of the illumination lamps 11 shown in FIG. 3. An operation/display section 119 has key switches for giving a board change instruction, copying instruction and so forth, as well as a display device for displaying the copy-ready state and so forth. A board member position detecting section 118 is composed of a position detector 118' such as a microswitch which is adapted to be actuated by a cam 120 which is attached to a reference position of the member 2, thereby to detect the arrival of the board member at the illuminated position or a position near the illuminated position during movement thereof in the direction of the arrow B (FIG. 3). The driving of the register roller is commenced in response to the signal from the detector 118. More specifically, the driving of the register roller 22 is commenced simultaneously with the production of the signal from the position detector 118' or after elapse of a certain time through the aforementioned delay circuit. Thus, the signals from the detectors 105, 118 are used as register timing signals.

The board member drive controller 115 is a device which is adapted to give various inspection signals for controlling the moving direction, starting and stopping of the board in accordance with a board moving instruction or a board copying instruction given by the operator. Namely, the driving device 117 is adapted for driving the web 2 by a stepping motor 5 in accordance with instructions given by the controller 115. The board section of the electric circuit includes an optical system position detector 112 which detects whether the mirror 13 and the lens 14 are at their board copying positions or their retracted positions for document copying. The optical system position detector 112 is constituted by, for example, a microswitch which operates when the hood 15 has been moved to the retracted position for the document copying mode.

An optical system driving device 125 includes a motor (not shown) for driving the hood 15 in accordance with a mode instruction signal and a solenoid (not shown) for driving the supporting member 34.

Various controllers in the board section 1 are connected through a connection device 123 to a signal change-over device 113 to which also are connected various devices 109, 107, 105 and 103 of the copier section and the process controller 101.

Figure 7:
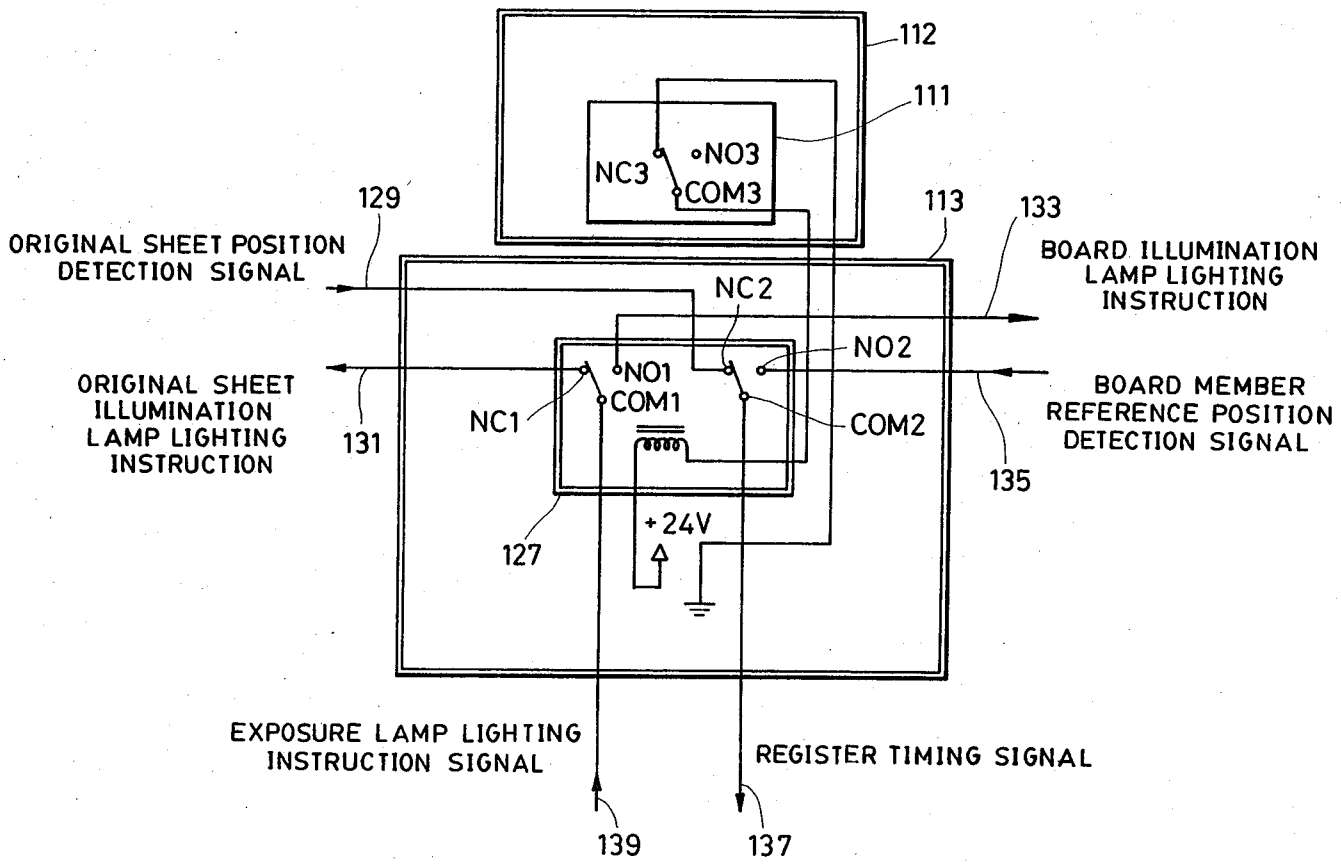

The signal change-over device 113 is a device for switching the connection between various input/output signals and the copying process controller, depending on whether the operation mode is the document copying mode or the board copying mode. An example of such a signal change-over switch 113 is shown in FIG. 7. When the microswitch 111 of the optical system position detector 112 is turned on during operation in the document copying mode, the terminals COM3 and NO3 of the microswitch are connected so that the coil of the relay 127 is de-energized, so that the detection signal from the original carrier position detector 105 is delivered as a transfer member transportation register timing signal to the copying process controller 101, through a line 129, relay contact NC2, COM2 and a line 137, whereas the exposure lamp lighting instruction signal from the device 101 is delivered as an original sheet lighting instruction at a predetermined timing to the original sheet illumination device 109, through a line 139, relay contact COM1, NC1 and the line 131.

Conversely, during operation in the board copying mode, the contacts NC3 and COM3 of the microswitch 111 are connected, so that the coil of the relay 127 is energized. In this case, the signal from the line 139 is delivered to the board illumination device 121 as an illumination lamp lighting instruction, through relay contacts COM1, NO1, line 133 and one of the contacts in the connection device 123. At the same time, a board member reference position detection signal from the position detector 118' from the position detecting section 118 is delivered to the line 137 through the connection device 123, line 135 and the relay contacts NO2 and COM2, and is input to the copying process controller 101 as the register timing signal, in the same manner as that described before.

The described arrangement is advantageous in that the number of lines connected to the copying process controller 101 is reduced and the construction of the apparatus is simplified, by virtue of the fact that similar signals from the board section and the copier section make common use of the line between the signal change-over device and the copying process controller. In addition, the copier section of the apparatus is usable as an ordinary copier, simply by being separated from the board section.

Figure 8:
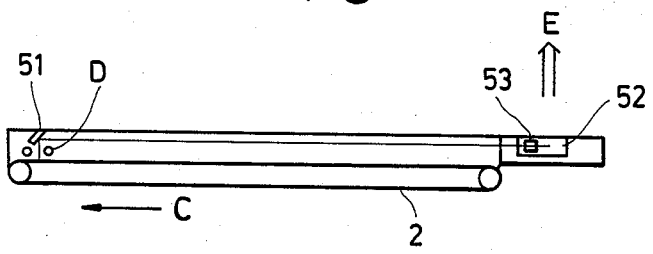
FIGS. 8 and 9 are schematic illustrations of another embodiment of the present invention.
Figure 9:
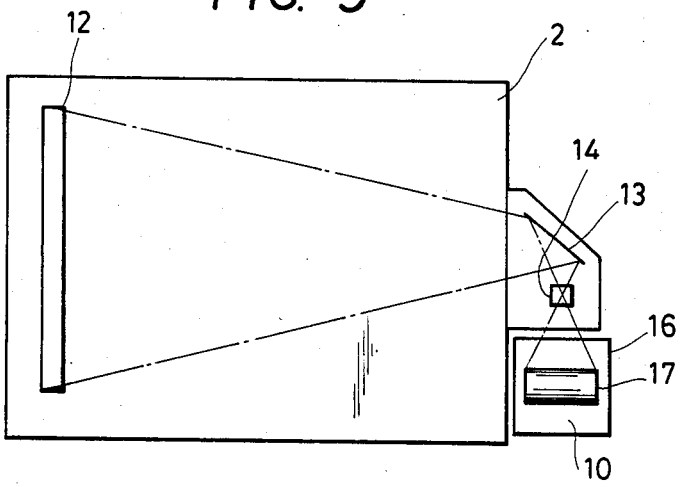

In the above described embodiment, the copy paper from the copying machine is ejected onto the tray 25 in direction E at the rear side of the board section 1. In addition, the sheet 2 is moved in the direction of arrow B so that the projection and exposure are conducted at the ilustrated position behind the recording side. This arrangement causes a slight time lag for the reference position of the web surface to reach the exposure position. This latter problem, however, is overcome by another embodiment of the invention which will be described hereinunder with reference to FIGS. 8 and 9, wherein the sheet 2 is moved in the direction of the arrow C and the copying operation is commenced when the leading end of the sheet 2 has arrived at the end D at the rear side of the board, so that the time lag is minimized.

Figure 10:
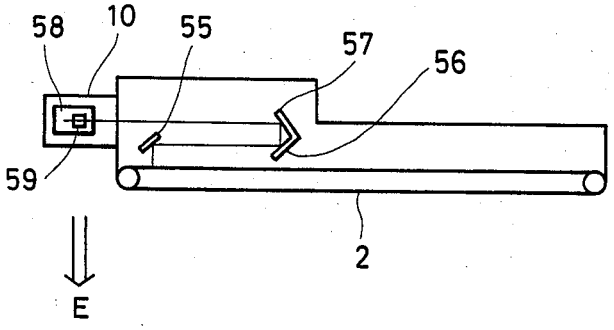
FIG. 10 is a schematic illustration of still another embodiment of the invention.

FIG. 10 discloses an optical system which is free from both of the above-noted disadvantages. More specifically, this optical system incorporates a first mirror 55, second mirror 56, third mirror 57, fourth mirror 58 and a lens 59. The optical system shown in FIG. 10 enables the copy paper to be ejected toward the front side of the board while minimizing the time lag, simply by changing the direction of the optical axis.

Although a copy board apparatus with a copier section having a movable original carrier has been described, it should be understood that the invention is not limited to such construction but applies equally well to a copy board apparatus with the stationary original carrier. In the case where the copier is of the stationary original carrier type, the original carrier cover is opened in the board copying mode so as to allow the light image from the board surface to reach the copier.

Moreover, while in the described embodiment the light image on the board is projected onto the photosensitive member of the copier through the lens 14, the invention is not limited to such construction and alternate ways for introducing the light image can be used. For instance, it is possible to use an optical system which includes a Fresnel lens placed as a field lens at a position corresponding to the original carrier of the copier. In this case, the image is formed on the Fresnel lens through the lens 14, and the image is formed again on the photosensitive member through the optical system of the copier including the mirror 30, lens 31 and the mirror 32.

Figure 1:
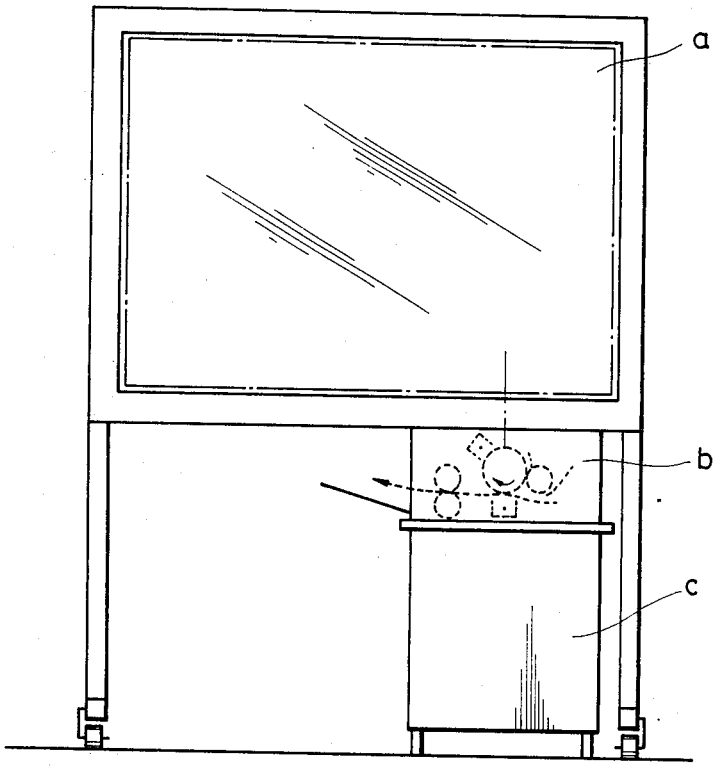
FIG. 1 PRIOR ART
FIG. 1 is an illustration of a copy board apparatus in accordance with the prior art.

It is to be understood also that, although in FIG. 1 the base 9 is formed integrally with the board supporting legs, the base 9 may be a pedestal which is independent from the board section and adapted to carry the copier. It is also possible to use a console type copier. In each case, the base preferably has a height-adjustment feature so that the copier may be placed at a predetermined position.

As has been described, according to the invention, there is provided a copy board apparatus in which a copier is placed on the right or the left side of a board as viewed from the front side thereof, and an optical system to project an image from the board to the copier. With this arrangement, it becomes possible to make use of the copier section of the apparatus either as a board copier or as an ordinary copier for copying an image of a document independently of the board, without requiring movement of the copier which is comparatively heavy.

For obtaining a multiplicity of copies of an image on the board, the board may be repetitionally moved back and forth so that a plurality of copies are obtained. Alternatively, a multiplicity of copies can be obtained by first obtaining a single copy by a board copying mode operation and then producing a plurality of copies by operating the copier in the document copying mode. In the latter case, the board can be used for further writing during the production of additional copies. In addition, since the copier is disposed outside the board section, the copying operation can be conducted without substantially obstructing the view of the users who are looking at the board surface.

What is claimed is:

1. A copy board apparatus for copying information recorded on a writing board, said apparatus comprising:

a board section including a web forming said writing board, rollers for supporting said web such that said web extends in a plane, and driving means for driving at least one of said rollers thereby to move said web;

a copier section including an electrophotographic copier having an original carrier and a photosensitive member, said copier being disposed adjacent one longitudinal end of said writing board;

a first optical system for forming, on said photosensitive member, an image of information recorded on said web;

a second optical system for forming, on said photosensitive member, an image of an original on said original carrier; and change-over means for effecting switching between said first and second optical systems.

2. A copy board apparatus according to claim 1, wherein said first optical system is disposed on the side of said writing board opposite the side where information is recorded thereon.

3. A copy board apparatus according to claim 1, wherein said first optical system is disposed on the side of said writing board opposite the side where information is recorded thereon and includes means for projecting the image to a region above said copier section, said projecting means being adapted to be received in a housing of said copy board.

4. A copy board apparatus for copying picture information recorded on a writing board, said apparatus comprising:

a board section including a web forming said writing board, rollers for supporting said web such that said web is movable in a horizontal direction, and driving means for driving at least one of said rollers thereby to move said web;

a copier section including an electrophotographic copier having an original carrier and a photosensitive member which is movable perpendicularly to the direction of movement of said web;

a first optical system for forming, on said photosensitive member, an image of information recorded on said web;

a second optical system for forming, on said photosensitive member, an image of an original on said original carrier of said copier; and a change-over means for effecting switching between said first and second optical systems.

5. A copy board apparatus according to claim 4, wherein said first optical system is disposed on the side of said writing board opposite the side where information is recorded thereon.

6. A copy board apparatus according to claim 4, wherein said first optical system includes a mirror which extends in a direction perpendicular to the direction of movement of said web, and an image forming lens disposed between said copier and said mirror, said image forming lens being adapted to reflect the light from said mirror towards said photosensitive member.

7. A copy board apparatus according to claim 6, wherein said mirror and said image forming lens of said first optical system are supported as a unit, and are adapted to be moved between a position above said copier and a position within said board section.

8. A copy board apparatus according to claim 4, wherein said original carrier is a movable carriage for conveying an original disposed thereon.

* * * * *

UNITED STATES PATENT AND TRADEMARK OFFICE

CERTIFICATE OF CORRECTION

PATENT NO. : 4,702,586

DATED : October 27, 1987

INVENTOR(S) : TAKASHI SAITO, ET AL.

It is certified that error appears in the above-identified patent and that said Letters Patent is hereby corrected as shown below:

COLUMN 3

Line 20, "frame 6" should read --frame 7--.
Line 22, "mirror 13" should read --mirror 12--.
Line 23, "mirror 13" should read --mirror 12--.

COLUMN 6

Line 53, "above described" should read --above-described--.
Line 58, "ilustrated" should read --illustrated--.

Signed and Sealed this

Twelfth Day of July, 1988

*Attest:*

DONALD J. QUIGG

*Attesting Officer*

*Commissioner of Patents and Trademarks*